US009615610B2

(12) United States Patent
Biller

(10) Patent No.: US 9,615,610 B2
(45) Date of Patent: Apr. 11, 2017

(54) OUTDOOR CONVERTIBLE GARMENT

(71) Applicant: Hope Biller, Los Angeles, CA (US)

(72) Inventor: Hope Biller, Los Angeles, CA (US)

( * ) Notice: Subject to any disclaimer, the term of this patent is extended or adjusted under 35 U.S.C. 154(b) by 330 days.

(21) Appl. No.: 14/295,572

(22) Filed: Jun. 4, 2014

(65) Prior Publication Data

US 2014/0366239 A1 Dec. 18, 2014

Related U.S. Application Data

(60) Provisional application No. 61/834,996, filed on Jun. 14, 2013.

(51) Int. Cl.

| | |
|---|---|
| ***A41D 3/00*** | (2006.01) |
| ***A41D 15/04*** | (2006.01) |
| ***A41D 15/00*** | (2006.01) |
| ***A41D 27/28*** | (2006.01) |

(52) U.S. Cl.

CPC ..... *A41D 3/00* (2013.01); *A41D 15/00* (2013.01); *A41D 15/04* (2013.01); *A41D 27/285* (2013.01); *A41D 2200/20* (2013.01)

(58) Field of Classification Search

CPC .. A45F 4/00; A47G 9/08; A47G 9/083; A47G 9/086; A41B 13/06; A41B 13/005; A41D 11/00; A41D 27/28; A41D 13/02; A41D 15/04; A41D 2600/108

See application file for complete search history.

(56) References Cited

U.S. PATENT DOCUMENTS

| | | | | | |
|---|---|---|---|---|---|
| 1,292,351 | A * | 1/1919 | Wilkes | 2/75 | |
| 1,513,410 | A * | 10/1924 | Milkes | 2/75 | |
| 2,372,110 | A * | 3/1945 | Noone | 2/84 | |
| 2,715,226 | A * | 8/1955 | Weiner | A41D 27/28 | 2/79 |
| 4,103,377 | A * | 8/1978 | Mayer et al. | 2/69.5 | |
| 4,667,344 | A * | 5/1987 | Cooper, III | A41D 3/04 | 2/227 |
| 4,703,521 | A * | 11/1987 | Asher et al. | 2/69 | |
| 4,989,282 | A * | 2/1991 | Goldstein | 5/413 R | |
| 5,226,193 | A * | 7/1993 | Chen | 2/69.5 | |
| 5,560,043 | A * | 10/1996 | Armstrong | 2/69.5 | |
| 5,642,526 | A * | 7/1997 | Thompson | A41D 13/02 | 2/69 |
| 5,815,833 | A * | 10/1998 | Kuo | 2/69.5 | |
| 6,266,822 | B1 * | 7/2001 | Joyce | 2/83 | |
| 6,370,692 | B1 * | 4/2002 | Duyn et al. | 2/86 | |
| 6,567,989 | B1 * | 5/2003 | Martinez | A41D 13/00 | 2/211 |
| 6,745,400 | B1 * | 6/2004 | Paciorkowski | A41D 13/0153 | 2/23 |
| 7,395,562 | B2 * | 7/2008 | Ricketts | A61G 1/04 | 2/202 |

(Continued)

*Primary Examiner* — Khaled Annis

(74) *Attorney, Agent, or Firm* — Caesar Rivise, PC

(57) ABSTRACT

A convertible garment for outdoor usage is disclosed. The garment basically comprises a quilted jacket-like upper member having a hood and a quilted zip-off skirt member. The skirt member is releasably secured to the jacket member by a zipper and when secured to the jacket upper member allows the wearer to remain warm by keeping his/her legs therein. The jacket member includes at least one air vent, as does the skirt member. The skirt member is arranged to be disconnected from the jacket member and opened and flattened to form a blanket.

14 Claims, 3 Drawing Sheets

(56) References Cited

U.S. PATENT DOCUMENTS

| | | | | |
|---|---|---|---|---|
| 2004/0216213 | A1* | 11/2004 | Paciorkowski | A41D 13/0153 2/69 |
| 2005/0210583 | A1* | 9/2005 | Cook | A47D 15/02 5/413 R |
| 2006/0277652 | A1* | 12/2006 | Okajima | A41D 13/00 2/93 |
| 2007/0293106 | A1* | 12/2007 | Harber | A41D 1/04 442/2 |
| 2008/0078027 | A1* | 4/2008 | Smith | 5/413 R |
| 2008/0148480 | A1* | 6/2008 | Narboni-Campora | 5/413 R |
| 2008/0196140 | A1* | 8/2008 | Mayerson | A41D 1/04 2/84 |
| 2008/0235848 | A1* | 10/2008 | Wilder et al. | 2/69.5 |
| 2009/0151071 | A1* | 6/2009 | Martin | 5/413 R |
| 2009/0178174 | A1* | 7/2009 | Cash, Jr. | A41D 1/08 2/69 |
| 2009/0293171 | A1* | 12/2009 | Fayle | A41D 27/10 2/85 |
| 2010/0127025 | A1* | 5/2010 | Kelling | A41D 15/04 224/153 |
| 2010/0256716 | A1* | 10/2010 | Haislip | A41D 15/04 607/108 |
| 2010/0299798 | A1* | 12/2010 | Fayle | A41D 27/10 2/69 |
| 2010/0313323 | A1* | 12/2010 | Tennelle | A41D 15/002 2/69 |
| 2011/0179548 | A1* | 7/2011 | Weston | 2/84 |
| 2013/0117903 | A1* | 5/2013 | Kanayama | A41D 27/28 2/69 |
| 2014/0165257 | A1* | 6/2014 | Wynh | 2/69.5 |
| 2014/0196192 | A1* | 7/2014 | Koller | A41D 3/02 2/85 |

* cited by examiner 26
20
22
28
30
34
36
44
46
32
66
62
60
76
24
70
48
52
50
46/72

OUTDOOR CONVERTIBLE GARMENT

CROSS-REFERENCE TO RELATED APPLICATIONS

This application claims priority from Provisional Application Ser. No. 61/834,996, filed on Jun. 14, 2013, entitled Outdoor Convertible Garment whose disclosure is incorporated by reference herein.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates generally to outdoor wearing apparel and more particularly to wearing apparel that can be readily converted for multi-purpose outdoor use, such as viewing sporting events in cold or inclement weather conditions.

BACKGROUND OF THE INVENTION

Jackets and other garments for keeping a user warm or otherwise protected from the environment are well known in the prior art. Such jackets come in many different designs, depending on their use or preference of the wearer. Sleeping bags are well known for keeping a user warm or otherwise protected from the environment. Such sleeping bags come in many different designs, depending on their use or preference of the wearer. Jackets and sleeping bags serve important, but different roles. Their use typically is limited to serving the purpose for which they were specifically designed.

While attempts have been made in the prior art to combine the functions of a jacket and a sleeping bag, such attempts have resulted in a compromise garment that does not fully meet the requirements of each role. Thus, there presently exists a need for garments that can be worn outdoors, such as by spectators to sporting events and other outdoor activities, that provides the wearer with the ability to customize the garment to the particular weather situation. The subject invention addresses that need by providing such a garment

SUMMARY OF THE INVENTION

A convertible outer garment is provided. The garment basically comprises a jacket member and a skirt member. The jacket member has a pair of arm sections and a torso section. The skirt member is releasably securable to the torso section of the jacket member and is arranged to be configured into a hollow body to enable the wearer of the garment to put his/her legs and feet therein. The skirt member is also arranged to be opened and flattened when disconnected from the jacket portion to form a blanket.

In accordance with one exemplary aspect of this invention the skirt member is arranged to be releasably secured to said jacket member by a zipper, e.g., the skirt member comprises a top edge portion along which portion of a zipper extends and wherein the torso section of the jacket member comprises a mating portion of that zipper extending along a bottom portion of the jacket member. The portions of the zipper are arranged to be connected together to releasably secure the skirt member to the jacket member.

In accordance with another exemplary aspect of this invention the skirt member additionally comprises a pair of side edges, one of which has one portion of another zipper extending therealong. The other of those side edges has another portion of the other zipper extending therealong. The portions of the other zipper are arranged to be secured together to configure the skirt member into a hollow body for receipt of the legs of the wearer.

In accordance with another exemplary aspect of this invention the skirt member additionally comprises a bottom edge and an associated drawstring. The drawstring is arranged to open and close an opening in the bottom of the skirt member when the skirt member is configured into the hollow body.

In accordance with another exemplary aspect of this invention the jacket member includes at least one air vent and the skirt member includes at least one air vent.

In accordance with another exemplary aspect of this invention the convertible garment includes a hood.

In accordance with another aspect of this invention the jacket member, the skirt member and the hood are each quilted and formed of a fabric shell having an fabric layer and an inner fabric layer, with an insulation material sandwiched therebetween.

DETAILED DESCRIPTION OF THE PREFERRED EMBODIMENT

Figure 1:
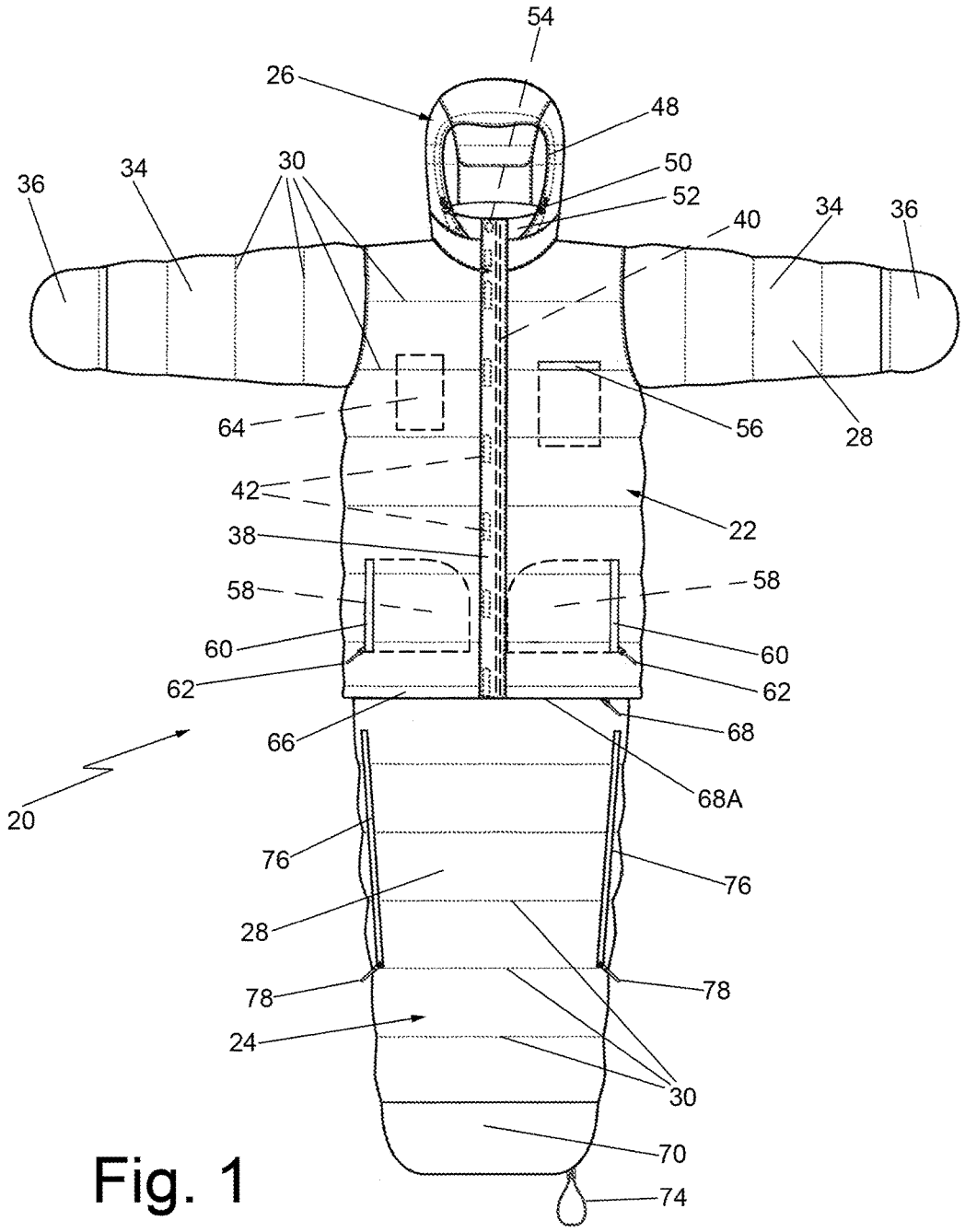
FIG. 1 is a plan view of the front side of one exemplary embodiment of an assembled multi-purpose convertible garment constructed in accordance with this invention.

Referring now to the various figures of the drawing, wherein like reference characters refer to like parts there is shown in FIG. 1 a plan view of one exemplary embodiment of a multi-purpose convertible garment 20 constructed in accordance with this invention. The details of the construction and use of garment 20 will be described in detail later. Suffice it for now to state that it is designed and arranged to provide a warmer, more comfortable way of being outdoors and enhancing one's outdoor experience while watching sporting events and while participating in other cold-weather activities. To that end the garment 20 basically comprises a quilted jacket-like upper member 22 having a hood 26 and a quilted zip-off skirt member 24. The skirt member is arranged to be releasably secured by a zipper to the jacket member. When so secured the resulting structure forms a cocoon like protective covering for virtually the entire body (other than the face) of the wearer. Moreover, the skirt member, when removed from the jacket member includes another zipper which is arranged to be unzipped to convert the skirt portion into a blanket. The garment includes plural zippered pockets and plural zippered air vents.

Owing to its construction the garment 20 can be used as a traditional jacket. Moreover, it can be converted for use by releasably securing the skirt member to the jacket member to form a cocoon like enclosure for the wearer's entire body. Thus, with the skirt member in place the wearer can remain warm by keeping his/her legs together thereby keeping body heat inside the garment. Moreover, the skirt member is constructed so that when it is secured to the jacket portion, the skirt portion can be unzipped to open it to enable the wearer to release or free his/her legs to him/her to freely walk about. Then when desired, e.g., after the person is seated or reclining, the skirt portion can zipped to close it around his/her legs and feet.

The entire garment is preferably quilted, i.e., includes a fabric shell 28 having an inner layer and an outer layer, each formed of any suitable material (a few examples of which will be described later), between which an insulating filler material is disposed. The filler material comprises any suitable thermally insulating material (a few examples of which will be described later). The quilting can take any form in any desired pattern. In the exemplary embodiment shown the quilting pattern is formed by plural parallel horizontally oriented stitch lines 30. Those stitch lines are merely exemplary of a myriad of patterns the quilting can take, e.g., a diamond pattern, etc.

The jacket portion 22 comprises a torso section 32 from which a pair of arm sections 34 extends. Each arm section terminates in an enclosed hand section 36. Each hand section includes a cuff with a hidden opening (not shown) to enable the wearer to extend his/her hands out of the opening and hence out of the garment 20. An internal Lycra pouch (not shown) is provided within the cuff of each hand section to provide additional warmth to the wearer. Thus, in particularly inclement weather the wearer can retain his/her body heat by keeping his/her hands within the Lycra pouch. Access to the torso section is provided via a zip-up front closure 38. The closure is in the form of a zipper 40 and associated hook and loop welt closures 42 to seal the welt and to better insulate the zipper 40 from the cold.

The fabric of the shell 28 making up the torso section 32 and each of the arm sections 34 is preferably 400 denier nylon, which has been given a water-resistant coating, but may be any other suitable material. The fabric of the shell making up the hand sections 36 is preferably poly taffeta, but may be any other suitable material. The filling of the torso section of jacket member is preferably 220G down-like polyester. The arm sections 34 are filled with 100G basic polyester. The arm cuffs are filled with 80G basic polyester. In the interest of comfort each of the arm sections 34 includes 2" darts 44 (FIG. 2) at the elbow to facilitate arm movement.

Figures 2, 3, 4, 5, 6:
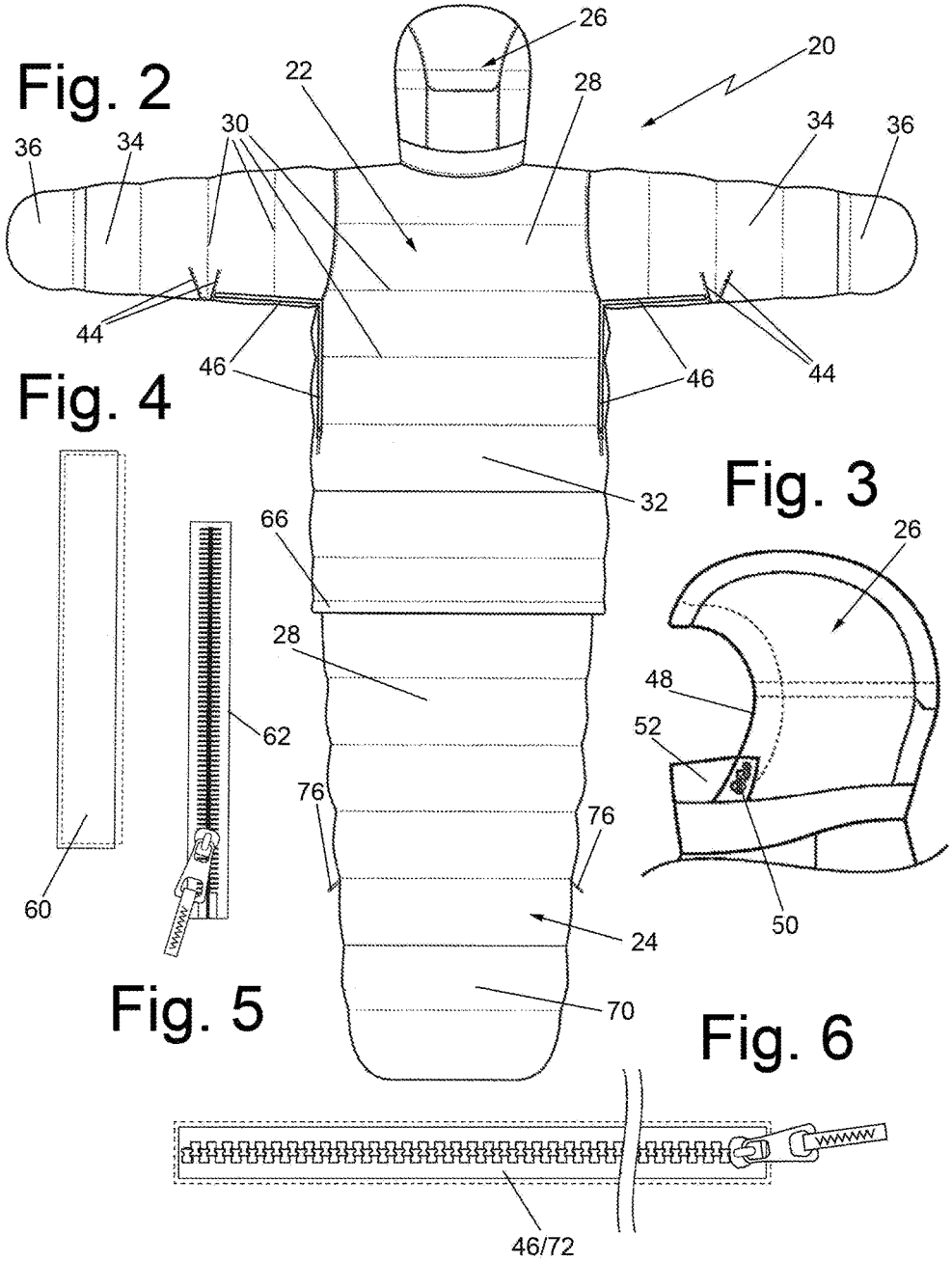
FIG. 2 is a plan view of the rear side of the exemplary garment shown in FIG. 1.
FIG. 3 is a somewhat enlarged side elevation view of a portion, e.g., a drop-hood, of the exemplary garment shown in FIG. 1.
FIG. 4 is an enlarged plan of the welt for one of the garment's pocket.
FIG. 5 is an enlarged plan view of a zipper for one of the garments pockets.
FIG. 6 an enlarged plan view of another zipper, e.g., the zipper located on the underside of the arms on the exterior of the garment and on the side of the skirt portion of the garment.

As best seen in FIG. 2, the torso section also includes pair of L-shaped air vents. Each vent is formed by a mesh lining (not shown) secured by an associated L-shaped zipper 46. Each zipper includes a portion, e.g., a 6 inch length, which extends along the underside of its associated arm section 38 from a point adjacent the elbow to the armpit and a portion, e.g., a 6 inch length, extending from the armpit to a point on the torso section adjacent the upper abdominal region. The zippers 46 are openable to allow external air to enter the garment in order to cool the user or internal warm air to exit the garment. In accordance with one preferred exemplary embodiment of this invention the zippers are #5 nylon coils zippers.

The hood 26 is preferably a quilted member constructed like that of the torso section, with the shell preferably formed of pad dye taffeta and filled with 80G basic polyester. The hood 26 is secured (e.g., preferably fixedly secured, such as by being sewn) to the upper portion of the torso section. The hood 26 is also preferably in the form of a drop hood having a visor extending above a face opening 48. The face opening can be adjusted in size by means of adjustable toggles 50 to accommodate various size and shaped faces. The hood also includes a 6" zipper guard 52 to protect the wearers face from the zipper 42, and a hidden metal snap 54.

The jacket portion includes three externally accessible pockets, namely, a 6.5" double welt zipper breast pocket 56 and two 7" welt side pockets 58 located in the exterior shell. The interior or lining of each of the pockets is formed by any suitable fabric, e.g., poly taffeta. The welt 60 making up each of the exterior pockets 56 and 58 is best seen in FIG. 4. A zipper 62 is provided within the welt for opening and closing each of the exterior pockets. That zipper 62 is preferably a #5 plastic zipper, having a metal pull with plastic zipper teeth and a ¼" by ¼" nylon webbing with bar tack that serves as the holding tab for the zipper pull as shown clearly in FIG. 5.

The exterior pockets 56 and 58 may be used to carry and/or store small items or as a place for the user to keep his/her hands warm and/or dry. The interior of the torso section includes another welted breast pocket 64, whose lining is also poly taffeta.

As best seen in FIGS. 1 and 2 the jacket member includes a 1" hem 66 with a ¼" top stitch at the bottom of the jacket. The top stitch is provided to enhance the aesthetic appeal of the garment. The hem 66 serves as the portion of the jacket to which the skirt member can be releasably connected. To that end, the hem includes one section 68A of a #10 zipper 68 which extends across the entire length of the jacket's hem. The zipper section 68A includes an associated #10 zipper pull. As will be described shortly, the skirt member 24 includes an edge portion along which the mating zipper section 68B of the zipper 68 extends. Thus, when the two zipper sections 68A and 68B are zipped together the skirt member 24 is attached to the jacket member 22, like shown in FIGS. 1 and 2.

Figure 7:
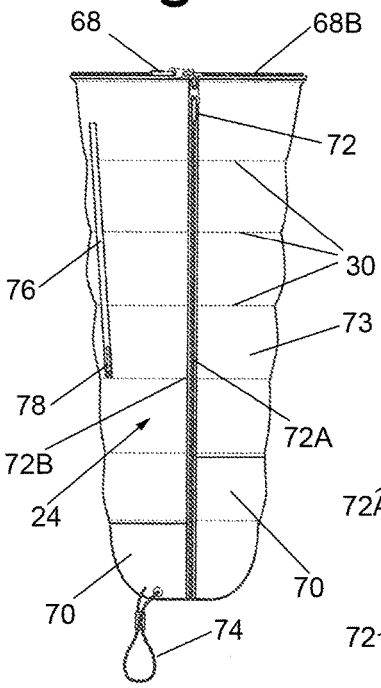
FIG. 7 is a somewhat reduced side elevation view of the skirt portion of the garment shown in FIG. 1.
Figure 8:
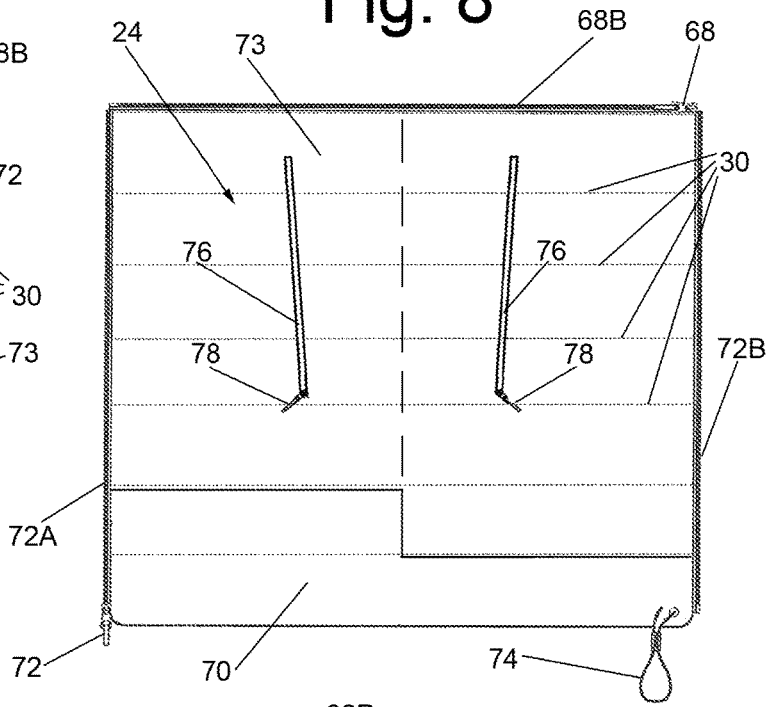
FIG. 8 is a plan view of the exterior surface of a blanket which has been formed by converting the skirt portion of the garment shown in FIG. 7 into the blanket.
Figure 9:
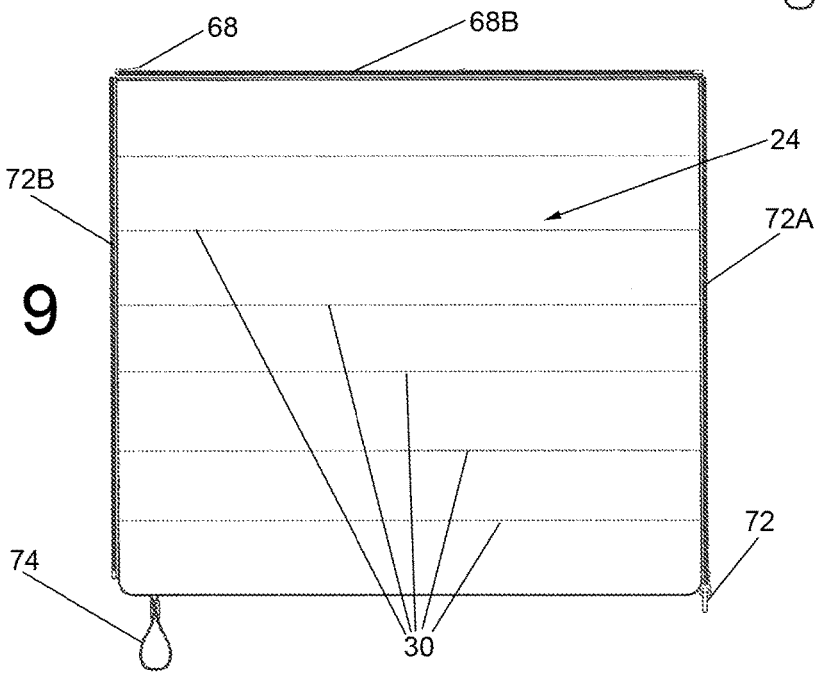
FIG. 9 is a plan view of the interior surface of the blanket shown in FIG. 8.

When separated from the jacket member 22 and laid flat the skirt member 24 is of generally square or rectangular shape, such as shown in FIGS. 8 and 9. In that state the skirt member can serve as a blanket. The skirt member 24 is constructed similarly to the jacket member. In this regard it is preferably a quilted member having a fabric shell and an insulation filler. The shell is preferably the same material as that used in the torso, section, i.e., P/D taffeta, filled with 220G down-like polyester, except for the bottom portion of the shell, which is designated by the reference number 70. That portion, while insulated by the same filler as the remainder of the skirt member, is formed of a strong, abrasion resistant, non-slip, rubber-coated, waterproof, reinforcing material, e.g., polyethylene tarpaulin, in place of the pad dye taffeta since that portion of the garment will be in contact with the ground when the wearer has the garment configured as shown in FIGS. 1 and 2 and the wearer is sitting or standing in the garment. The tarpaulin portion 70 extends higher up the back side of the skirt member than it does up the front side as can be seen in FIGS. 1 and 2 since the feet of the wearer will be juxtaposed with respect to the tarpaulin portion 70 on the rear side of the skirt member when the wearer is seated with his/her feet on the ground and the bottom of the skirt member closed by the drawstring. The entire rear side of the skirt portion of the garment is constructed of 400D nylon as seen in FIGS. 7 and 8, which is designated by the reference number 73. The 400D material is more durable and water-resistant than the rest of the garment and provides added protection while sitting in inclement weather.

As mentioned above and best seen in FIG. 8 the top edge of the skirt member includes the heretofore identified zipper section 68B of the zipper 68 extending therealong. In order to enable the skirt section to be formed into a hollow body for receipt of the legs and feet of the wearer the side edges of the skirt member are arranged to be releasably secured to each other by another zipper 72 (FIG. 7). To that end, one side edge of the skirt member includes one section 72A of a #5 plastic zipper with metal teeth extending the entire length of that side edge. The other side edge of the skirt member includes the mating zipper section 72B of the zipper 72, which extends along the full length of that side edge. Thus, when the zipper section 72A is secured to the zipper section 72B, the skirt member is in the form of a hollow cylinder. A drawstring 74 is located in a passageway or hem section (not shown) along the bottom edge of the skirt member to serve as a closure to close the bottom of the skirt member when the drawstring is pulled in one direction. This enables the skirt member to fully enclose the legs and feet of the wearer, like shown in FIGS. 1, 2 and 7. The drawstring can be pulled in the opposite direction to open the bottom of the skirt member. Thus, the drawstring allows the skirt member to be closed or open to allow the wearer's feet to being either inside or outside of the garment 20. As such, the wearer is able to pull the bottom of the skirt member up to his/her waist and cinch the drawstring thereby allowing the wearer to walk around freely.

As best seen in FIGS. 1, 7, 8 and 9 the skirt portion 24 includes two 6" side vents 76. Each side vent is mesh lined and arranged to be opened and closed by an associated zipper 78 extending along the length of the vent. Each zipper is preferably a #5 nylon coil zipper.

As should be appreciated from the foregoing this convertible garment of this invention provides the wearer with a warmer, more comfortable way of being outdoors and enhancing one's outdoor experience while watching sporting events and other cold weather activities. The garment basically comprises a ski jacket-like upper member having a zip-off skirt member. The skirt member when coupled to the jacket-like upper member allows the wearer to remain warm by keeping his/her legs together and thereby keeping body heat inside the garment. One can choose to walk around in the upper garment and then zip the lower portion when seated or can place the entire garment on while seated on lying down. Moreover, the skirt member, when disconnected from the jacket member can be readily formed into a blanket. Thus, the garment of this invention offers the user various ways to configure it for various outdoor applications. Moreover, while the garment has been described by means of one exemplary embodiment, it should be clear that various changes can be made to the garment, such as use of different materials for the shell and filling. Moreover, the garment can be made in different shapes and sizes. Further still, different types of releasably securable fasteners can be used in lieu of or in addition to the disclosed zippers for securing the various components of the garment together. Further still, while it is preferred that the garment include air vents in the jacket member and vents in the skirt member, the number, placement and arrangement of such vents can be tailored to the particular application. In fact, if desired, the garment may be devoid of vents. Moreover, while a hood is also preferred to be included in the garment, it can be omitted if desired.

Without further elaboration the foregoing will so fully illustrate my invention that others may, by applying current or future knowledge, adopt the same for use under various conditions of service.

I claim:

1. An outer garment configured to be worn by a person outdoors, said garment comprising:

a jacket member having a pair of arm sections and a torso section, said torso section having a first side and a second side, a first one of said pair of arm sections being located at said first side and fixedly secured to said first side and a second one of said pair of arms sections being located at said second side and fixedly secured to said second side, each of said arm sections being an elongated hollow member terminating in an enclosed hand section, each of said hand sections including a cuff to enable the wearer to extend his/her hands out of the hand section, said jacket member including a first openable and closable air vent and a second openable and closable air vent, said first air vent comprising an elongated slit located in at least one of said first arm section and said first side of said torso section immediately below said first arm section, said second air vent comprising an elongated slit located in at least one of said second arm section and said second side of said torso section immediately below said second arm section; and a skirt member releasably securable to said torso section of said jacket member, said skirt member comprising an abrasion resistant, non-slip, waterproof material making up a bottom area of said outer garment for engagement with the ground, said skirt member being configurable into a closed state wherein said skirt member is in the form of a bag having a single hollow enclosed body to enable the wearer of the garment to put both legs and feet of said wearer in said single hollow enclosed body, said skirt member also being configurable into an open state when said skirt member is disconnected from said jacket portion, whereupon said hollow enclosed body of said skirt member is opened and flattened to form a blanket.

2. The outer garment of claim 1 wherein said jacket member and said skirt member are formed of a quilted material.

3. The outer garment of claim 1 wherein said skirt member is arranged to be releasably secured to said jacket member by a zipper.

4. The outer garment of claim 1 wherein said first air vent is L-shaped and includes a portion located in said first arm section and a portion located in said first side of said torso section and wherein said second air vent is L-shaped and includes a portion located in said second arm section and a portion located in said second side of said torso section.

5. The outer garment of claim 3 wherein said skirt member comprises a top edge portion along which portion of said zipper extends and wherein said torso section of said jacket member comprises a mating portion of said zipper extending along a bottom portion of said jacket member, said portions of said zipper being connectable whereupon said portions of said zipper can be connected together to releasably secure said skirt member to said jacket member.

6. The outer garment of claim 5 wherein said skirt member additionally comprises a pair of side edges, one of said side edges having one portion of another zipper extending therealong, the other of said side edges having another portion of said other zipper extending therealong, said portions of said other zipper being arranged to be connected together to configure said skirt member into said hollow enclosed body for receipt of the legs of the wearer.

7. The outer garment of claim 6 wherein said skirt member additionally comprises a bottom edge and an associated drawstring, said drawstring arranged to open and close an opening in the bottom of said skirt member when said skirt member is configured into said hollow body.

8. The outer garment of claim 4 wherein said first air vent includes a zipper and wherein said second air vent includes a zipper.

9. The outer garment of claim 1 wherein said skirt member comprises at least one openable and closable air vent.

10. The outer garment of claim 8 wherein said skirt member comprises at least one openable and closable air vent.

11. The outer garment of claim 9 wherein said at least one vent includes a zipper.

12. The outer garment of claim 1 additionally comprising a hood portion secured to said jacket member.

13. The outer garment of claim 12 wherein said hood portion includes a face opening.

14. The outer garment of claim 13 wherein the size of the face opening is adjustable.

* * * * *